US007736088B2

(12) United States Patent
Boxall et al.

(10) Patent No.: US 7,736,088 B2
(45) Date of Patent: Jun. 15, 2010

(54) RECTANGULAR LOAD PLATE

(76) Inventors: Russell Boxall, P.O. Box 1411, Matthews, NC (US) 28106; Nigel Parkes, 8945 Ridgemont Dr., Atlanta, GA (US) 30350-1611

( * ) Notice: Subject to any disclaimer, the term of this patent is extended or adjusted under 35 U.S.C. 154(b) by 0 days.

(21) Appl. No.: 11/457,394

(22) Filed: Jul. 13, 2006

(65) Prior Publication Data

US 2008/0014018 A1 Jan. 17, 2008

(51) Int. Cl.
*E01C 11/14* (2006.01)

(52) U.S. Cl. ..... 404/60; 404/58; 404/61; 249/9

(58) Field of Classification Search ..... 404/56, 404/37, 38, 48, 49, 50, 51, 53; 249/207, 249/9

See application file for complete search history.

(56) References Cited

U.S. PATENT DOCUMENTS

| | | | |
|---|---|---|---|
| 0,094,066 | A | 8/1869 | Betteley |
| 0,602,769 | A | 4/1898 | Parker |
| 0,714,971 | A | 12/1902 | Thacker |
| 0,748,746 | A | 1/1904 | Kelsey |
| 0,811,560 | A | 2/1906 | Hinchman |
| 0,828,550 | A | 8/1906 | Inman et al |
| 0,881,762 | A | 3/1908 | Adreon, Jr. |
| 0,920,808 | A | 5/1909 | Alcott |
| 1,092,734 | A | 4/1914 | McLoughlin |
| 1,298,018 | A | 3/1919 | Davis |
| 1,557,165 | A | 10/1925 | Hooper |
| 1,604,992 | A | 11/1926 | Gregg |
| 1,632,395 | A | 6/1927 | Fellows |
| 1,753,316 | A | 4/1930 | Robertson |
| 1,894,395 | A | 1/1933 | Burrell |
| 2,064,528 | A | 12/1936 | Fischer |
| 2,103,337 | A | 12/1937 | Oury |
| 2,121,303 | A | 6/1938 | Robertson |

(Continued)

FOREIGN PATENT DOCUMENTS

| | | |
|---|---|---|
| AT | 348222 | 10/1977 |

(Continued)

OTHER PUBLICATIONS

May 2, 2008 Order Denying Preliminary Injunction (Continued)

*Primary Examiner*—Raymond W Addie
(74) *Attorney, Agent, or Firm*—Banner & Witcoff, Ltd.

(57) ABSTRACT

A generally rectangular load plate for transferring loads between a first cast-in-place slab and a second cast-in-place slab separated by a joint. The load plate being adapted to transfer load between the first and second slabs directed essentially perpendicular to the intended upper surface of the first slab, and allowing relative movement between adjacent concrete slabs along the joint between the slabs with minimal joint opening between the slabs. A pocket former embedded within the first slab may also be included to position the load plate and create void space on the sides of the load plate to permit the relative movement. A compressible material along the side of the load plate may also be used to permit the relative movement. Neither the void space created by the pocket former nor the compressible material are dependent upon the existence of a significant gap in the joint between the concrete slabs.

6 Claims, 3 Drawing Sheets

U.S. PATENT DOCUMENTS

| | | | | |
|---|---|---|---|---|
| 2,149,467 | A | 3/1939 | Robertson | |
| 2,167,904 | A * | 8/1939 | Older | 404/55 |
| 2,181,005 | A | 11/1939 | Westcott | |
| 2,193,129 | A | 3/1940 | Geyer | |
| 2,201,134 | A | 5/1940 | Brickman | |
| 2,207,168 | A | 7/1940 | Thomas | |
| RE21,996 | E | 1/1942 | Oates | |
| 2,308,677 | A | 1/1943 | Daily | |
| 2,309,538 | A | 1/1943 | Robertson | |
| 2,316,233 | A | 4/1943 | Fischer | |
| 2,319,972 | A | 5/1943 | Brickman | |
| 2,337,156 | A | 12/1943 | Elmendorf | |
| 2,349,983 | A | 5/1944 | Musall | |
| 2,416,584 | A | 2/1947 | Heltzel | |
| 2,441,903 | A | 5/1948 | Robertson | |
| 2,509,180 | A | 5/1950 | Yeoman | |
| 2,531,040 | A | 11/1950 | Heltzel | |
| 2,589,815 | A | 3/1952 | Jacobson | |
| 2,654,297 | A | 10/1953 | Nettleton | |
| 2,775,924 | A | 1/1957 | Brickman | |
| 2,780,149 | A | 2/1957 | Heltzel | |
| 3,104,600 | A | 9/1963 | White | |
| 3,246,433 | A | 4/1966 | Eriksson | |
| 3,331,623 | A | 7/1967 | Baresel-Bofinger | |
| 3,430,406 | A | 3/1969 | Weber | |
| 3,434,263 | A | 3/1969 | Beckman et al | |
| 3,559,541 | A * | 2/1971 | Watstein | 404/60 |
| 3,561,185 | A | 2/1971 | Finsterwalder et al | |
| 3,855,754 | A | 12/1974 | Scoville | |
| 3,859,769 | A | 1/1975 | Watkins | |
| 3,960,460 | A | 6/1976 | Fischer | |
| 3,972,640 | A | 8/1976 | Miller | |
| 4,091,589 | A | 5/1978 | Moot | |
| 4,257,207 | A | 3/1981 | Davis | |
| 4,353,666 | A | 10/1982 | Brandley | |
| 4,373,829 | A | 2/1983 | Braxell | |
| 4,453,360 | A | 6/1984 | Barenberg | |
| 4,531,564 | A | 7/1985 | Hanna | |
| 4,641,988 | A | 2/1987 | Ganner | |
| 4,733,513 | A * | 3/1988 | Schrader et al. | 52/396.02 |
| 4,883,385 | A | 11/1989 | Kaler | |
| 4,996,816 | A | 3/1991 | Wiebe | |
| 5,005,331 | A | 4/1991 | Shaw et al. | |
| 5,216,862 | A | 6/1993 | Shaw et al. | |
| 5,261,194 | A | 11/1993 | Roberts | |
| 5,261,635 | A | 11/1993 | Flathau | |
| 5,366,319 | A | 11/1994 | Hu | |
| 5,419,965 | A | 5/1995 | Hampson | |
| 5,439,308 | A | 8/1995 | Beaulieu | |
| 5,458,433 | A | 10/1995 | Stastny | |
| 5,487,249 | A | 1/1996 | Shaw et al. | |
| 5,560,151 | A | 10/1996 | Roberts | |
| 5,574,028 | A | 11/1996 | Bodick | |
| 5,623,799 | A | 4/1997 | Kowalski | |
| 5,640,821 | A | 6/1997 | Koch | |
| 5,674,028 | A * | 10/1997 | Norin | 404/74 |
| 5,713,174 | A | 2/1998 | Kramer | |
| 5,730,544 | A | 3/1998 | Dils et al. | |
| 5,797,231 | A * | 8/1998 | Kramer | 52/396.02 |
| 5,941,045 | A | 8/1999 | Plehanoff | |
| 6,019,546 | A | 2/2000 | Ruiz | |
| 6,052,964 | A | 4/2000 | Ferm | |
| 6,145,262 | A * | 11/2000 | Schrader et al. | 52/396.02 |
| 6,195,956 | B1 | 3/2001 | Reyneveld | |
| 6,354,053 | B1 | 3/2002 | Kerrels | |
| 6,354,760 | B1 * | 3/2002 | Boxall et al. | 404/56 |
| 6,471,441 | B1 | 10/2002 | Muller | |
| 6,532,714 | B1 | 3/2003 | Ferm | |
| 6,926,463 | B2 | 8/2005 | Shaw | |
| 7,004,443 | B2 | 2/2006 | Bennett | |
| 7,201,535 | B2 | 4/2007 | Kramer | |
| 7,228,666 | B2 | 6/2007 | Michiels | |
| 7,314,333 | B2 * | 1/2008 | Shaw et al. | 404/60 |
| 7,338,230 | B2 * | 3/2008 | Shaw et al. | 404/58 |
| 7,441,985 | B2 * | 10/2008 | Kelly et al. | 404/56 |
| 2006/0177267 | A1 | 8/2006 | Carroll | |
| 2007/0231068 | A1 * | 10/2007 | Francies et al. | 404/56 |

FOREIGN PATENT DOCUMENTS

| | | |
|---|---|---|
| CH | 594106 | 12/1977 |
| DE | 894706 | 9/1942 |
| DE | 726829 | 9/1953 |
| DE | 152821 | 9/1981 |
| EP | 032105 B1 | 7/1981 |
| EP | 0059171 A1 | 1/1982 |
| EP | 0328484 A1 | 8/1989 |
| GB | 2285641 A | 7/1995 |
| WO | 96/39564 | 12/1996 |
| WO | WO99/31329 | 6/1999 |
| WO | WO/2004/065694 A1 | 8/2004 |

OTHER PUBLICATIONS

Feb. 22, 2008 Memorandum in support of motion for preliminary injunction based on infringement of U.S. Patent No. 6,354,760.

Apr. 7, 2008 Response in opposition to the motion for preliminary injunction based on infringement of the U.S. Patent No. 6,354,760.

(Court Pleading) *P.N.A. Construction Technologies Inc.* v. *McTech Group, Inc., et al.*, "Memorandum in Support of Plaintiff P.N.A. Construction Technologies, Inc.'s Motion for Preliminary Injunction" and Exhibits A-P, Aug. 12, 2005, 60 pages, filed in the United States District Court for the Northern District of Georgia, Atlanta Division, Court No. 1:05-cv1753-WSD.

(Court Pleading) *P.N.A. Construction Technologies, Inc.* v. *McTech Group, Inc., et al.*, "Defendants McTech Group, Inc.'s McDonald Technology Group, LLC's, and Stephen F. McDonald's Opposition to Plaintiff's Motion for a Preliminary Injunction," Aug. 24, 2005, p. Nos. (top labeled) 1 (cover) and 13-21, filed in the United States District Court for the Northern District of Georgia, Atlanta Division, Court No. 1:05-cv-1753-WSD.

(Court Pleading) *P.N.A. Construction Technologies, Inc.* v. *McTech Group, Inc., et al.*, "Plaintiff's Responses and Objections to Defendants' first Set of Interrogatories," Sep. 26, 2005, p. Nos. 1 (cover) and 12-13 (Interrogatory No. 7/Answer to Interrogatory No. 7), filed in the United States District Court for the Northern District of Georgia, Atlanta Division, Court No. Court No. 1:05-cv-1753-WSD.

(Court Pleading) *P.N.A. Construction Technologies, Inc.* v. *McTech Group, Inc., et al.*, "Plaintiff P.N.A. Construction Technologies, Inc. 's Supplemental Memorandum in Support of Its Motion for a Preliminary Injuction," Oct. 31, 2005, p. Nos. 1 (cover) and 12-21 (bottom labeled), filed in the United States District Court for the Northern District of Georgia, Atlanta Division, Court No. 1:05-cv-1753-WSD.

(Drawing Sheet) PNA Construction Technologies Inc., "PNA Square Dowel Basket Isometric," Current, Sheet SDB-1, Jun. 2004, Atlanta, GA, 1 page.

(Court Pleading) *P.N.A. Construction Technologies, Inc.* v. *McTech Group, Inc., et al.*, "Plaintiff's Responses and Objections to Defendants' First Set of Requests for Admission (Nos. 1-3)," Nov. 21, 2005, p. Nos. 1 and 3, filed in the United States District Court for the Northern District of Georgia, Atlanta Division, Court No. 1:05-cv-1753-WSD.

(Court Pleading) *P.N.A. Construction Technologies, Inc.* v. *McTech Group, Inc., et al.*, "Order," Feb. 8, 2006, p. Nos. 1-31, filed in the United States District Court for the Northern District of Georgia, Atlanta Division, Court No. 1:05-cv-1753-WSD.

(Court Pleading) *P.N.A. Construction Technologies, Inc.* v. *McTech Group, Inc., et al.*, "Consent Judgment and Permanent Injunction," May 4, 2006, p. Nos. 1-3, filed in the United States District Court for the Northern District of Georgia, Atlanta Division, Court No. 1:05-cv-1753-WSD.

(Deposition Transcript) *P.N.A. Construction Technologies, Inc.* v. *McTech Group, Inc.*, et al., Deposition transcript of Nigel K. Parkes, Oct. 5, 2005, p. Nos. 51-58, Atlanta, GA.

(Report) ACI Committee 360, "Design of Slabs-on-Ground, ACI 260R-06," Aug. 9, 2006, p. Nos. 360R-1 to 360R-74.

(Report) ACI Committee 302, "Guide for Concrete Floor and Slab Construction, ACI 302.1R-04," Mar. 23, 2004, p. Nos. 302.1R-1 to 302.1R-77.

(Magazine Article) Wayne W. Walker and Jerry A. Holland, "Performance-Based Dowel Deisgn, Lift-truck design changes require a new look at joint durability," Concrete Construction—The World of Concrete, Jan. 2007 World of Concrete Official Show Issue, Hanley Wood, pp. 1-8.

(Magazine Article) Nigel Parkes, "A Decade of Dowel Development," L&M Concrete News, Jan. 2007: vol. 7, No. 1, p. Nos. Cover, 8-10.

(Magazine Article) Wayne W. Walker and Jerry A. Holland, "Plate Dowels for Slabs on Ground," American Concrete Institute—Concrete International, Jul. 1998, p. Nos. Cover, 32-38.

(Magazine Article) Ernest K. Schrader, "A Solution to Cracking and Stresses Caused by Dowels and Tie Bars," American Concrete Institute—Concrete International, Jul. 1991, p. Nos. unknown (6 pgs. total).

(Magazine Article) Greg K. Fricks and Nigel K. Parkes, "Innovations for Durable Floors," Concrete Construction, The World of Concrete, Jan. 2002 by Hanley-Wood Publication, p. Nos. unknown (4 pgs. total).

(Magazine Article) Grecory Scurto, David Scurto, Wayne W. Walker, and Jerry A. Holland, "Cost-Effective Slabs-on-Ground," American Concrete Institute—Concrete International, May 2004, p. Nos. 65-67.

(Web Page) PNA Construction Technologies, "Square Dowel Baskets," Current, 1 page printed from PNA website found under "Products."

(Product Instructions) PNA Construction Technologies, "PD3 Basket Assembly Instructions for Use, " Source: American Concrete Association, R&T Update, "Dowel Basket Tie Wires: Leaving Them Intact Does Not Affect Pavement Performance," Jan. 2005, 1 page.

(Brochure) PNA Construction Technologies, "PD3 Basket Assembly," Source Material: Concrete Construction, "Performance-Based Dowel Design," Jan. 2007, Wayne Walker and Jerry Holland, 1 page.

(Drawing Sheet) PNA Construction Technologies, "PNA PD3 Basket Assembly Isometric," Current, Sheet PD3-1, Aug. 2006, Atlanta, GA, 1 page.

(Photographs and Diagrams) PNA Construction Technologies' unpublished photographs of product installation images for Boxall and PD3 Dowel Plates, Current, 4 pages.

(Magazine Article) Wayne W. Walker and Jerry A. Holland, Thou Shalt Not Curl Nor Crack . . . (hopefully), Concrete International, Jan. 1999, 7 pages.

(Seminar Booklet) Steve Metzger and Metzger/McGuire, "Handling Joints In Industrial Concrete Floors," World of Concrete 2005, Las Vegas, NV, 28 pages.

(Manuscript) Nigel K. Parkes, "Improved Load Transfer and Reduced Joint Spelling Systems for both Construction and Contraction Joints," International Colloquium of Industrial Floors, Jan. 2003, Esslingen, Germany, 11 pages.

(Magazine Article) Greg K. Fricks and Nigel K. Parks, "Innovations for Durable Floors," Concrete Construction, The World of Concrete, Jan. 2002 Hanley-Wood Publication, 4 pages.

(Magazine Article) Nigel Parkes, "Designing the Cost-Effective Slab-on-Ground Least Likely to Crack or Spall," Structure Magazine, Apr. 2007, p. Nos. 10-12.

(Court Pleading) *Greenstreak Group, Inc.* v. *P.N.A. Construction Technologies, Inc.*, Court No. 4:07-CV-02099-DJS, "Plaintiff's Second Supplemental Objections and Responses to Interrogatory No. 2 of P.N.A. Construction Technologies' First Set of Interrogatories to Greenstreak," (including Exhibit A), Filed Jul. 10, 2008, pp. 16.

Shrader, "A Proposed Solution to Cracking Caused by Dowels," Concrete Construction (Dec. 1987).

William F. Perenchino, Avoiding Common Mistakes in Concrete Joint Design, Construction Renovation Facilities, reprinted from Plant Engineering, Jan. 11, 1990, Cahners Publishing Company, pp. 5.

William Van Breemen and E. A. Finney, "Design and Construction of Joints in Concrete Pavements," Journal of the American Concrete Institute, Jun. 1950, pp. 789-879.

Arnold, "Diamond Dowels for Slabs on Ground, " Concrete (Jun. 1998).

Arnold, "Joint Armouring and Load Transfer," Concrete (Sep. 2006).

E. A. Finney, "Structural Design Considerations for Pavement Joints," Title No. 53-1, part of copyrighted Journal of The American Concrete Institute, V. 28, No. 1, Jul. 1956.

Portland Cement Association, Concrete Floors on Ground (2d ed. 1983).

The Concrete Society, Technical Report No. 34: Concrete Industrial Ground Floors (3d ed. 2003).

Greenstreak, "Laser Form Job Site Guide" (undated).

Bolourchi, et al., "Federal Highway Administration Technical Report FHWA-LA-97, Evaluation of Load Transfer Devices (Patent 4,453,360)," Nov. 1975.

* cited by examiner

FIG.4
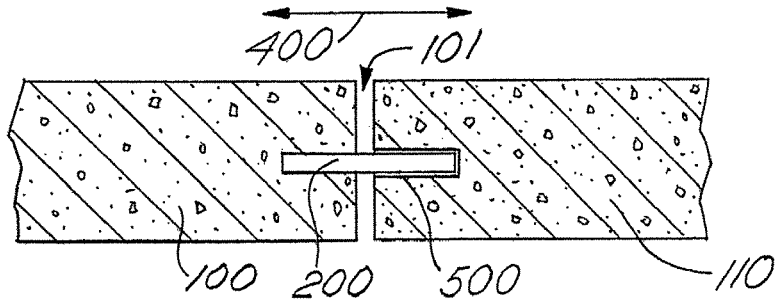
FIG.5
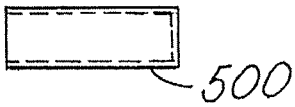
FIG.5A
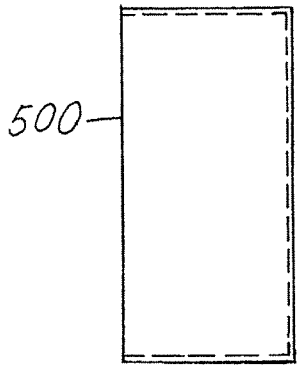
FIG.6
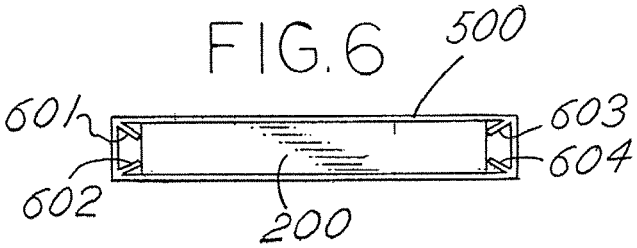
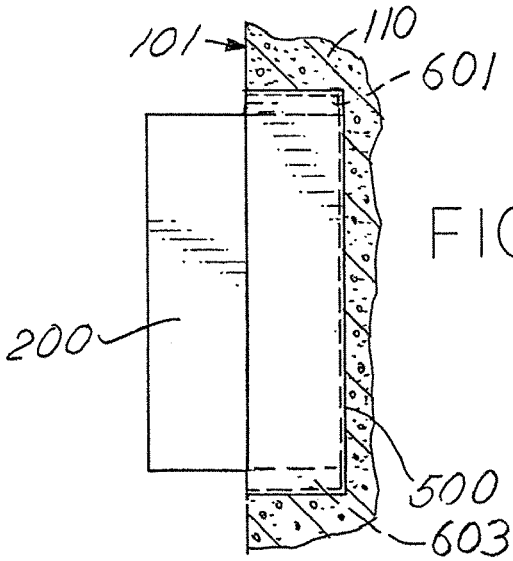
FIG.7

RECTANGULAR LOAD PLATE

BACKGROUND OF THE INVENTION

1. Field of the Invention

This invention relates generally to transferring loads between adjacent cast-in-place slabs, and, more particularly, to a system for transferring, across a joint between a first slab and a second slab, a load applied to either slab.

2. Related Art

A concrete floor is typically made up of a series of individual blocks or slabs, as shown in FIG. 1. The same is true for sidewalks, driveways, roads, and the like. Individual slabs provide several advantages including relief of internal stress due to drying shrinkage and thermal movement. Adjacent slabs meet at joints. Joints are typically spaced so that each slab has enough strength to overcome internal stresses that would otherwise cause random stress relief cracks. In practice, slabs should be allowed to move individually but should also be able to transfer loads from one slab to an adjacent slab. Transferring loads between slabs is usually accomplished using dowels, embedded in the two adjacent slabs defining the joint.

U.S. Pat. Nos. 5,005,331, 5,216,862, and 5,487,249 issued to Shaw et al., incorporated herein by reference, disclose tubular dowel receiving pocket formers for use with dowel bars having a circular cross-section.

If circular or square dowels, are misaligned (i.e., not positioned perpendicular to the joint), they can undesirably lock the joint together causing unwanted stresses that could lead to slab failure in the form of cracking. Another shortcoming of square and round dowels is that they typically allow slabs to move only along the longitudinal axis of the dowel. Such restraint of movement in directions other than parallel to the longitudinal axes of dowels may result in slab failure in the form of cracking.

U.S. Pat. No. 4,733,513 issued to Schrader et al., incorporated herein by reference, discloses a dowel bar having a rectangular cross-section and resilient facings attached to the sides of the bar. A shortcoming of prior art dowel bars results from the fact that, under a load, only the first 3-4 inches of each dowel bar is typically used for transferring the load. This creates very high loadings per square inch at the edge of slab, which can result in failure of the concrete below dowel. Such a failure could also occur above dowel.

U.S. Pat. No. 6,354,760 ("the '760 patent"issued to Boxall and Parkes, incorporated herein by reference, discloses a tapered load plate for transferring loads between adjacent concrete slabs. The tapered load plate permits relative movement between slabs in a direction parallel to the longitudinal axis of the joint, while reducing the loading per square inch of the dowel close to the joint. A pocket former embedded within one of the slabs for positioning the load plate is also disclosed.

In the '760 patent, the relative movement of the two adjacent concrete slabs is directly proportional to the extent that the joint between the two slabs opens due to the requirement of a tapered load plate. I.e., the more the joint opens, the more lateral movement is permitted.

Accordingly, there is a need in the art for a load plate system that provides for significant relative movement along the joint between two adjacent concrete slabs where the joint between the slabs opens only enough to overcome the interface friction between the two adjacent concrete slabs.

SUMMARY OF THE INVENTION

A load plate is disclosed for transferring loads between a first cast-in-place slab and a second cast-in-place slab separated by a joint. The load plate comprises a generally rectangular shape having a width measured parallel to the joint, a length measured perpendicular to the joint, an essentially planar upper and lower surfaces adapted to protrude into and engage the first slab, and the load plate being adapted to transfer between the first and second slabs a load directed essentially perpendicular to the intended upper surface of the first slab. The thickness of the load plate is measured perpendicular to the upper surface of the first slab.

A pocket former embedded within the first slab could also be included. The pocket former could have an essentially planar top surface and an essentially planar bottom surface essentially parallel to the upper surface of the first slab. The width of the pocket former could be sufficiently greater than the width of the load plate, such that the load plate could move within the pocket former in a direction parallel to the intersection between the upper surface of the first slab and the joint surface. The pocket former could include a plurality of deformable centering fins or other means for initially centering the load plate within the width of the pocket former. The centering fins would easily collapse under load to allow the plate to move in a direction parallel to the joint. Those of skill in the art would recognize that other means might be employed to allow the load plate to move in a direction parallel to the joint. For example, compressible material along the sides of the load plate, either with or without a pocket former would achieve the desired result.

The width of the load plate could be approximately twice the depth of the embedded end. Depth is the dimension of the load plate embedded in the slab. For a generally rectangular load plate equally embedded in two adjacent slabs, the depth would equal approximately half the length.

This invention also comprises a load plate kit having component parts capable of being assembled during creation of a joint between first and second cast-in-place slabs including: a mounting plate adapted to be attached to the edge form; a pocket former adapted to be attached to the mounting plate; and a load plate such that the load plate and pocket former are adapted to transfer a load between the first and second slabs.

This invention also comprises a method of installing a load plate for transferring loads between a first cast-in-place slab and a second cast-in-place slab, including the steps of: placing an edge form on the ground; attaching a pocket former to the edge form; removing the edge form from the first slab, with the pocket former remaining within the first slab; inserting an essentially rectangular load plate into the pocket former, a remaining portion of the load plate protruding into a space to be occupied by the second slab; pouring cast-in-place material into the space to be occupied by the second slab; and allowing the second slab to harden.

BRIEF DESCRIPTION OF THE DRAWINGS

FIG. 4 is a side view of a load plate and two adjacent cast-in-place slabs.

FIG. 5 is a side view of a pocket former.

FIG. 5A is a top view of the pocket former shown in FIG. 5 along the indicated sectional view line A-A in FIG. 5.

FIG. 6 is a front view of the pocket former of FIG. 6 showing the collapsible centering fins.

FIG. 7 is a top view of a pocket former with collapsible fins and load plate showing the capability to allow extra relative movement between adjacent slabs along the longitudinal axis of the joint.

DETAILED DESCRIPTION OF THE PREFERRED EMBODIMENTS

Instead of a dowel to transfer a load between adjacent cast-in-place slabs, a generally rectangular plate that is relatively wide compared to its thickness can be used. The load plate 200 will have its greatest dimension closest to joint 101.

Figure 1:
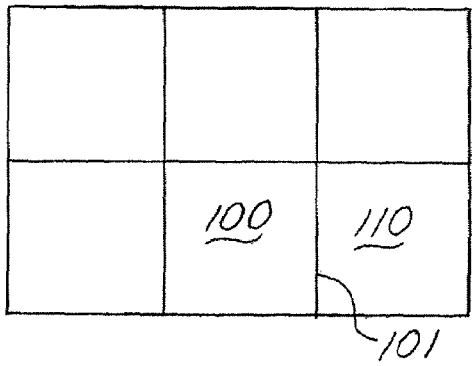
FIG. 1 is a top view of a concrete floor.

The load plate 200 will generally distribute the load across the width of the plate generally at the location where slabs 100, 110 meet at joint 101 as shown in FIG. 1. Load plate 200 thereby reduces failure of slabs close to joints, which, in turn, overcomes a significant shortcoming of prior art dowel bars. Unlike prior art dowels, the load plate 200 does not place unneeded material farther from joint 101 where loading is significantly reduced compared with loads closer to joint 101. As a result, load plate 200 optimizes the use of material relative to prior art dowels, which undesirably place more dowel material than necessary deep into slabs 100, 110 and not enough material close to joints 101.

Figure 2:
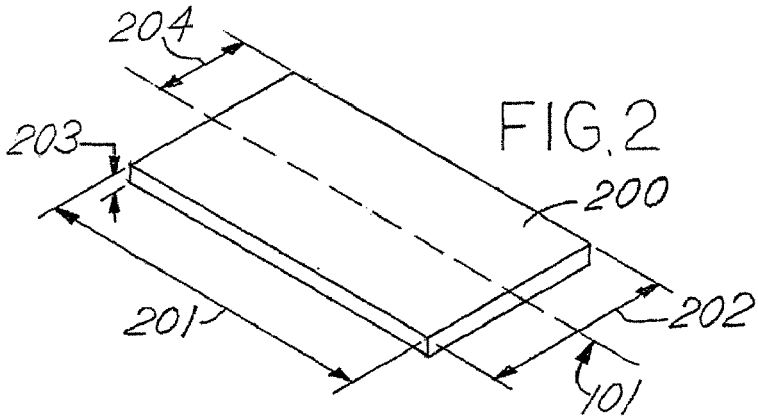
FIG. 2 is a perspective view of a load plate showing the width, length, depth, and thickness with respect to a construction joint between concrete slabs.

Referring to FIG. 2, the load plate 200 has dimensions of width 201, length 202, and thickness 203. The depth 204 is the dimension of the embedded load plate 200, and typically is approximately half the length 202.

Figure 3:
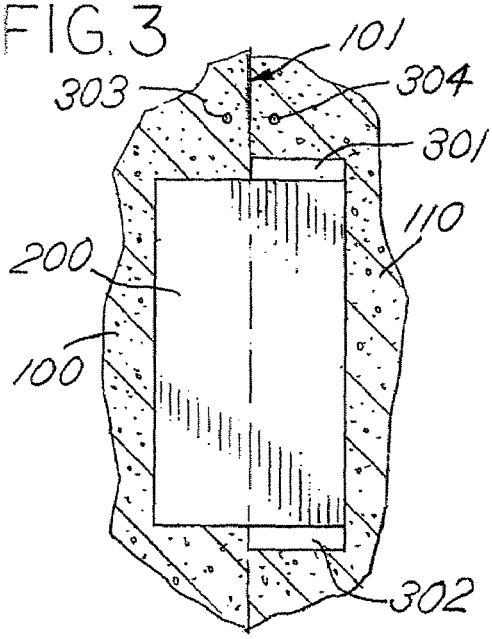
FIG. 3 is a top view of a load plate between adjacent cast-in-place slabs.
Figure 3A:
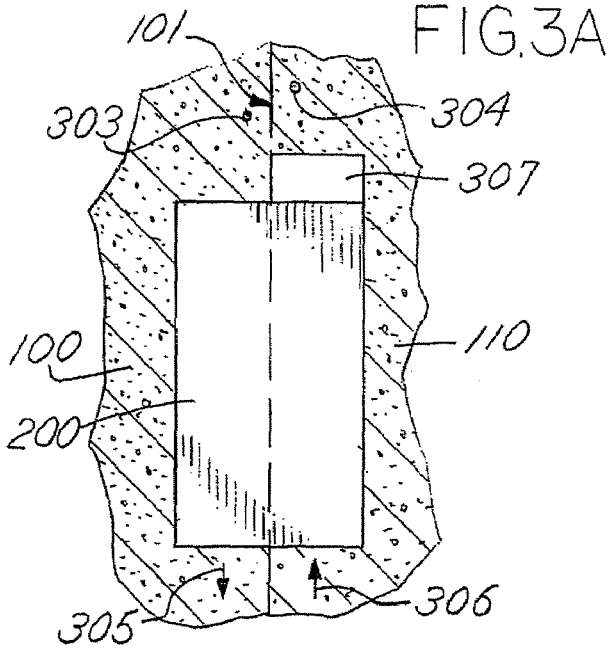
FIG. 3A illustrates how the voids at the side of the load plates allow movement parallel to the construction joint.

Referring to FIG. 3, the load plate 200 is positioned between adjacent concrete slabs 100, 110 at joint 101. Void spaces 301, 302 on either end of load plate 200 allow the load plate to move in a direction parallel to the joint 101. Position points 303, 304 are initially directly adjacent across joint 101 as shown in FIG. 3. When relative movement of slabs of slabs 110, 110 along joint 101 occurs, for example due to loadings 305, 306 shown in FIG. 3A, the position points 303, 304 reflect the relative movement, and the enlarged void space 307 results.

Figure 10:
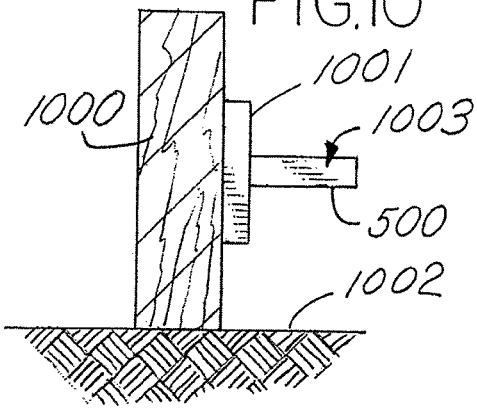
FIG. 10 is a side view of the pocket former mounted to formwork using a mounting plate.

A pocket former 500 may be cast in to the first concrete slab 100, to form void for inserting the load plate 200 after the formwork 1000 shown in FIG. 10 is removed. FIGS. 5 and 5A show side and top view of the pocket former 500. FIG. 7 shows the generally rectangular load plate inserted into the pocket former 500. The collapsible fins of the pocket former 500 create void spaces that allow extra relative movement between adjacent slabs along the longitudinal axis of the joint.

FIG. 6 shows a front view of the pocket former with collapsible fins 601, 602, 603, 604. The collapsible fins assist in the positioning of the load plate 200 before the second concrete slab 110 is poured, which encases the load plate 200. The collapsible fins 601, 602, 603, and 604 in the pocket former 500 allow the load plate 200 anchored in the first concrete slab 110 to move relative to the second concrete slab 100 in either direction parallel to the longitudinal axis of joint 01, which directions are depicted by arrows 305 and 306 in FIG. 3A. A sufficient opening of the joint 101, typically due to slab shrinkage, is necessary to allow relative movement between the concrete slabs 100 and 110, to overcome interface friction between the slabs 100, 110 of a closed joint. Persons skilled in the art are aware that interface friction is, in part, due to the irregular nature of the joint due to the aggregate in the concrete, etc. The joint 100 between the slabs 110, 100 opens in the direction of the double headed arrow 400 shown in FIG. 4. Once the joint 100 has opened sufficiently to overcome the irregularities due to the aggregate, etc., however, the two concrete slabs 100, 110 may move relative to one another to the full extent permitted by the collapsible fins.

Figure 10A:
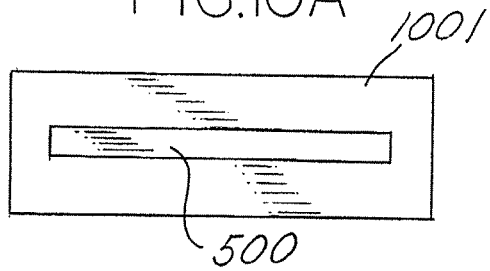
FIG. 10A shows an end view of the pocket former and mounting plate.
Figure 10B:
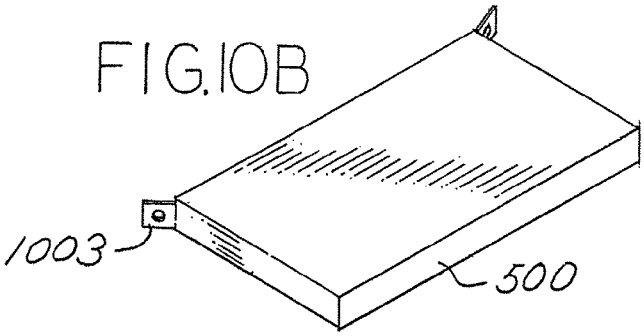
FIG. 10B shows a pocket former with flanges for mounting the pocket former to the formwork.

To install a load plate 200 during creation of a joint 101, a pocket former 500 and mounting plate 1001 could be used. The mounting plate 1001 positions the pocket former 500 before the first concrete slab 100 is poured, which encases the pocket former 500. FIG. 10 is a side view of a possible configuration for attaching a pocket former 500 using a mounting plate 1001. FIG. 10A shows and end view of the pocket former 500 and mounting plate 1001. Those of skill in the art will recognize that other alternatives for mounting the pocket former are available, including flanges 1003 on the pocket former 500 for nailing the pocket former to the formwork 1000 as shown in FIG. 10B.

After allowing the first slab to harden, the edge form 1000 and mounting plate 1001 could be removed, leaving pocket former 500 remaining within hardened first slab 100. A first half or end of load plate 200, for instance, the right-hand half of load plate 200 depicted in FIG. 4, could then be inserted into the pocket former 500 embedded in hardened slab 110. A second pocket former could then optionally be positioned over a second half or end load plate 200, for instance the left-hand side of load plate 200 depicted in FIG. 4. Then, a second slab 100 could be poured and allowed to harden such that the second end of the load plate, and optionally the second pocket former, will be embedded in the second slab. The use of a second pocket former with collapsible fins 601, 602, 603, 604 would permit greater relative movement along the joint between the two concrete slabs due to the added void space on the side of the load plate due to the second set of collapsible fins.

Figure 8:
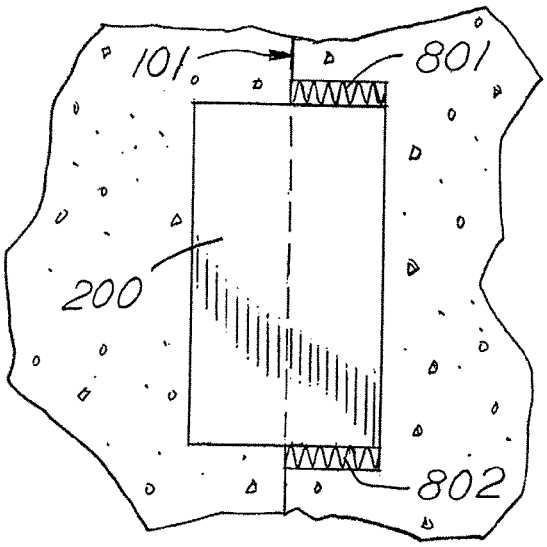
FIG. 8 is a top view of a load plate with compressible material along the side of the plate depth that allows extra relative movement between adjacent slabs along the longitudinal axis of the joint.
Figure 9:
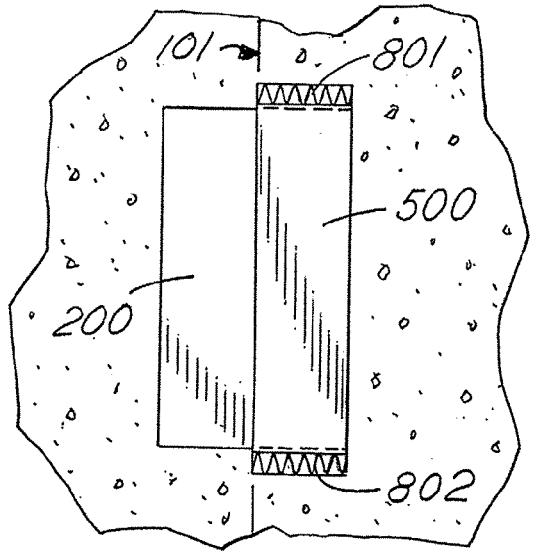
FIG. 9 is a top view of a pocket former and load plate with collapsible material along the side of the plate depth that allows extra relative movement between adjacent slabs along the longitudinal axis of the joint. The pocket former may or may not have collapsible fins.

In an alternative embodiment shown in FIG. 8, compressible material 801 along the side of the load plate 200 may be used in order to allow relevant movement of the adjacent concrete slabs. The compressible material may be used either with or without a pocket former 500, but if a pocket former 500 is not used, then an anti-friction material or mechanism, such as grease, other lubricant, or polymer coating, must be used in order to eliminate the interface friction between the top and bottom face of the load plate 200 and the concrete which encases the load plate 200 so that the load plate can move relative to the concrete slab.

This invention comprises a kit of component parts capable of being assembled during creation of joint 101 between two slabs 100, 110. Referring to FIG. 10, creation of joints 101 between slabs 100, 110 is typically accomplished by placing an edge form 1000 on a base 1002, typically the ground. The edge form 1000 could be a 2×6 inch board of wood, to define a first joint surface. Mounting plate 1001 could be attached to an edge form 1000 that will define the joint surface of a first slab 100, with stub 1003 protruding into a space to be occupied by the first slab, as shown in FIG. 10. Pocket former 500 could then be slipped onto stub 1003. The first slab could then be poured. After allowing the first slab to harden, the edge form and mounting plate 1001 could be removed, leaving pocket former 500 remaining within hardened first slab 100.

A first half or end of load plate 200 could then be inserted into the pocket former 500 embedded in hardened first slab 100. A second pocket former could then optionally be positioned over a second half or end load plate 200. Then, a second slab 110 could be poured and allowed to harden such that the second end of the load plate, and optionally the second pocket former, will be embedded in the second slab.

This invention has been described with reference to a preferred embodiment. Modifications may occur to others upon reading and understanding the foregoing detailed description. This invention includes all such modifications to the extent that they come within the scope of the appended claims or their equivalents.

We claim:

1. A concrete joint load plate system for transferring loads across a joint between two adjacent concrete on-ground cast-in-place slab panels, and for providing significant relative movement longitudinally along the joint between the two adjacent slab panels even where the joint opens only enough to overcome the interface friction between slab panels, the load plate system comprising:

a first concrete on-ground cast-in-place slab panel;

removeable formwork for the casting of the first concrete on-ground cast-in-place slab panel, the formwork adapted and configured to be installed before the casting of the first slab panel to thereby define a first joint surface of the first slab panel, and removed from the first slab panel before the casting of a hereinafter-identified second concrete on-ground cast-in-place slab panel;

a second concrete on-ground cast-in-place slab panel cast in part in the location of the removed formwork and against the first joint surface of the first slab panel such as to experience interface friction of the second slab panel with the first slab panel;

a joint between the first and second slab panels, wherein an essentially planar upper surface of the first slab panel is essentially perpendicular to a joint surface of the first slab panel, and a longitudinal axis of the joint is formed by an intersection of the joint surface of the first slab panel and the upper surface of the first slab panel;

a generally rectangular load plate having upper and lower surfaces, a length, a non-tapering width that remains essentially constant along essentially the entire length of the load plate, and a thickness between the upper and lower surfaces that is essentially less than one-eighth of the width of the load plate;

a pocket former configured to receive the load plate, the pocket former having collapsible fins that are configured to position the received load plate during installation, the pocket former adapted and configured to be mounted to the removable formwork in the area in which the first slab panel is to be cast, to remain in the area and be embedded in the first slab panel by being separated from and not removed with the formwork when the formwork is removed, and to receive a load plate upon the removal of the formwork;

the second slab panel being substantially free of interconnection to the first slab apart from the interface friction of the second slab panel with the first slab panel and apart from load transfer caused by load plates;

whereby a first end of the load plate protrudes into the pocket former, and a second end of the load plate protrudes into the second slab panel such that the load plate's width is oriented essentially parallel to the longitudinal axis of the joint, the load plate's length is oriented perpendicular to the joint surface of the first slab panel, and the load plate is configured to transfer between the first and second slab panels a load applied to either slab panel directed essentially perpendicular to the upper surface of the first slab panel, and the load plate does not place unneeded material farther from the joint where loading is significantly reduced compared with loads closer to the joint;

whereby relative movement along the longitudinal axis of the joint between the concrete slab panels is permitted when the fins of the pocket former collapse to allow the load plate to close a generally rectangular void space created by the fins; and the plate, pocket former, fins, slab panels and joint constructed and arranged as described such that the system provides significant relative movement longitudinally along the joint between the slab panels where the joint opens only enough to overcome the interface friction between the slab panels.

2. The system of claim 1 wherein the width of the load plate is essentially greater than or equal to the length of the load plate.

3. The system of claim 1, wherein the load plate is essentially square.

4. Concrete joint load plate apparatus for use in transferring a load across a joint between first and second cast-in-place slab panels, and for providing significant relative movement longitudinally along the joint between the two adjacent slab panels even where the joint opens only enough to overcome the interface friction between slab panels, the joint having an essentially planar joint surface essentially perpendicular to an essentially planar intended upper surface of the first slab panel, the joint surface being formed by removable formwork that is adapted and configured to be installed before the casting of the first slab panel and removed from the first slab panel before the casting of the second slab panel, the second slab panel being substantially free of interconnection to the first slab panel apart from interface friction of the second slab panel with the first slab panel and apart from load transfer caused by the joint load plate apparatus, the interface friction brought into existence by the second slab panel being cast in the part of the removable formwork when removed and against the first joint surface of the first slab panel, the joint load plate apparatus comprising:

a pocket former adapted to be mounted to the removable formwork in the area in which the first slab panel is to be cast, to remain in the area and be embedded within the first slab panel such that an essentially planar top surface and an essentially planar bottom surface of the pocket former are essentially parallel to the intended upper surface of the first slab panel, the top and bottom surfaces of the pocket former each having a width oriented parallel to an intersection between the joint surface and the upper surface of the first slab panel;

a generally rectangular load plate having essentially planar upper and lower surfaces, a length, a non-tapering width that remains essentially constant along essentially the entire length of the load plate and that is essentially greater than or equal to the length, and a thickness between the upper and lower surfaces, the load plate being adapted to be inserted into the pocket former, the remaining portion of the load plate being adapted to be embedded in the second slab panel; and the pocket former adapted to position the load plate within the pocket former such that the load plate's width is oriented essentially parallel to the longitudinal axis of the joint, and the load plate's length is oriented perpendicularly to the joint surface of the first slab panel, thereby leaving generally rectangular void spaces along opposite sides of the load plate to allow relative movement of the load plate within the pocket former with respect to the concrete slab panel that the pocket former is encased within, along the longitudinal axis of the joint, and such that the load plate does not place unneeded material farther from the joint where loading is significantly reduced compared with loads closer to the joint;

the load plate and the pocket former being adapted to transfer between the first and second slab panels any load applied to either the first or second slab panels in a direction perpendicular to the intended upper surface of the first slab panel, and the load plate, pocket former, slab panels and joint being constructed and arranged as described such that the apparatus provides significant relative movement longitudinally along the joint between the slab panels where the joint opens only enough to overcome the interface friction between the slab panels.

5. The apparatus of claim 4 wherein the pocket former has collapsible fins configured to position the load plate and create generally rectangular void spaces along opposite sides of the load plate.

6. The apparatus of claim 4 wherein a second pocket former with collapsible fins is used on the end of the load plate protruding into the second concrete slab panel.

* * * * *